United States Patent [19]

Nachbar et al.

[11] Patent Number: 5,022,192

[45] Date of Patent: Jun. 11, 1991

[54] CONDUIT GRINDING APPARATUS

[75] Inventors: Henry D. Nachbar, Ballston Lake; Alfred S. Korytkowski, Scotia, both of N.Y.

[73] Assignee: The United States of America as represented by the United States Department of Energy, Washington, D.C.

[21] Appl. No.: 504,152

[22] Filed: Apr. 3, 1990

[51] Int. Cl.[5] ..... B24B 15/00

[52] U.S. Cl. ..... 51/241 A; 51/245

[58] Field of Search ..... 51/241 R, 241 S, 241 B, 51/241 X S, 241 A, 245

[56] References Cited

U.S. PATENT DOCUMENTS

| | | | |
|---|---|---|---|
| 1,031,934 | 7/1912 | Hunter | 51/241 B |
| 2,535,587 | 12/1950 | McGovern et al. | 51/245 |
| 2,659,186 | 11/1953 | Burkholder | 51/245 |
| 2,772,529 | 12/1956 | Dutro | 51/245 |
| 4,033,229 | 7/1977 | Sarnelli | 51/245 |
| 4,107,884 | 8/1978 | Morris | 51/245 |
| 4,246,728 | 1/1981 | Leasher | 51/241 S |
| 4,362,447 | 12/1982 | Pekar et al. | 409/200 |
| 4,388,782 | 6/1983 | Rodgers et al. | 51/241 A |
| 4,513,542 | 4/1985 | Wilger et al. | 51/241 S |
| 4,525,956 | 7/1985 | Sears et al. | 51/241 B |
| 4,534,135 | 8/1985 | Wilger et al. | 51/241 S |
| 4,696,544 | 9/1987 | Costella | 350/96.26 |

*Primary Examiner*—Roscoe V. Parker

*Attorney, Agent, or Firm*—Virginia B. Caress; William R. Moser; Richard E. Constant

[57] ABSTRACT

A grinding apparatus for grinding the interior portion of a valve stem receiving area of a valve. The apparatus comprises a faceplate, a plurality of cams mounted to an interior face of the faceplate, a locking bolt to lock the faceplate at a predetermined position on the valve, a movable grinder and a guide tube for positioning an optical viewer proximate the area to be grinded. The apparatus can either be rotated about the valve for grinding an area of the inner diameter of a valve stem receiving area or locked at a predetermined position to grind a specific point in the receiving area.

14 Claims, 1 Drawing Sheet

CONDUIT GRINDING APPARATUS

The Government has rights in this invention pursuant to Contract No. DE-AC12-76N00052 awarded by the U.S. Department of Energy.

BACKGROUND OF THE INVENTION

1. Field of the Invention

The present invention relates to a grinding apparatus and, more particularly, to an apparatus for grinding weld defects in a valve stem receiving area of a valve.

2. Prior Art

Devices for grinding, machining and resurfacing cylindrical objects are well known in the art. U.S. Pat. No. 4,246,728 to Leasher discloses a tool for treating an end of a tubular conduit having a rotatable body. U.S. Pat. No. 4,362,447 to Pekar et al discloses an adjustable face milling cutter carried on a turntable rotatable about a central axis to machine a circular path on an upper tubesheet surface. U.S. Pat. No. 4,388,782 to Rodgers et al discloses a grinder for preparing circular seats behind elliptical handholes of marine boilers. U.S. Pat. No. 4,513,542 by Wilger et al discloses a portable surfacing machine for boiler manholes. U.S. Pat. No. 4,534,135 to Wilger et al discloses a grinding machine for watertight hatch lugs. And U.S. Pat. No. 2,772,529 to Dutro discloses a cylinder block ridge grinder. In addition, U.S. Pat. No. 4,696,544 to Costella discloses a fiberscopic device for inspecting internal sections of construction.

In the manufacture of large valves, such as steam stop valves, parts must be welded together. When welding is involved, such as welding a ring type insert onto the internal flow surface of a steam stop valve, defects can appear. In order to provide a functional valve, these welding defects must be removed.

It is therefore an objective of the present invention to provide a grinding apparatus that can be placed into a valve through the valve stem area when the valve actuator, bonnet and valve gate are removed.

It is another objective of the present invention to provide a grinder that can grind the interior of conduits having a pneumatic motor for grinding and a fiberscopic device for visual observations of the grinding operation.

It is another objective of the present invention to provide an interior conduit grinder that can remove a local defect while the device is clamped in place or remove a continual defect on the 360 degree inner circumference of the weld between a ring type insert and a valve body when the grinder is not clamped in place.

It is another objective of the present invention to provide a grinder with a grinder motor that is adjustable for various depths of cuts.

SUMMARY OF THE INVENTION

The foregoing problems are overcome and other advantages are provided by a grinding apparatus for grinding the interior of a conduit.

In accordance with one embodiment of the invention the grinding apparatus comprises a faceplate means, cam means, locking means and grinding means. The faceplate means is provided for positioning on a conduit aperture. The cam means is located on the faceplate means for rotatably mounting the faceplate means with a conduit aperture. The locking means is provided for locking the faceplate means in a predetermined position at a conduit aperture. The grinding means is movably mounted on the faceplate means whereby the grinding means can be fixed to the faceplate means at a predetermined position and the faceplate means can be rotated about a conduit aperture to axially rotate the grinding means to grind the inner circumference of a conduit, and the faceplate means can be locked at a predetermined position at a conduit aperture and the grinding means radially moved relative to the faceplate means to grind a specific interior portion.

In accordance with another embodiment of the invention, a weld grinding apparatus is provided for grinding welds in an interior portion of a valve stem receiving area of a valve.

The apparatus comprises faceplate means, means for mounting the faceplate means to a valve stem receiving aperture, grinding means and guide tube means. The faceplate means can be mounted over a valve stem receiving aperture. The means for mounting the faceplate means to a valve stem receiving aperture include cam means mounted on the faceplate means for contacting an interior portion of a valve stem receiving area, the cam means allowing the faceplate means to rotatably move about a valve stem receiving aperture. Locking means are provided for locking the faceplate means at a predetermined position. The grinding means is movably mounted on the faceplate means and comprises a motor means, a grinding wheel and a pivoting motor mount for movably mounting the motor means and grinding wheel relative to the faceplate means for substantially radial movement relative thereto. The guide tube means provides a passage for an instrument for viewing a target area therethrough.

BRIEF DESCRIPTION OF THE DRAWINGS

The foregoing aspects and other features of the invention are explained in the following description, taken in connection with the accompanying drawings, wherein.

DETAILED DESCRIPTION OF THE INVENTION

Figures 1, 2:
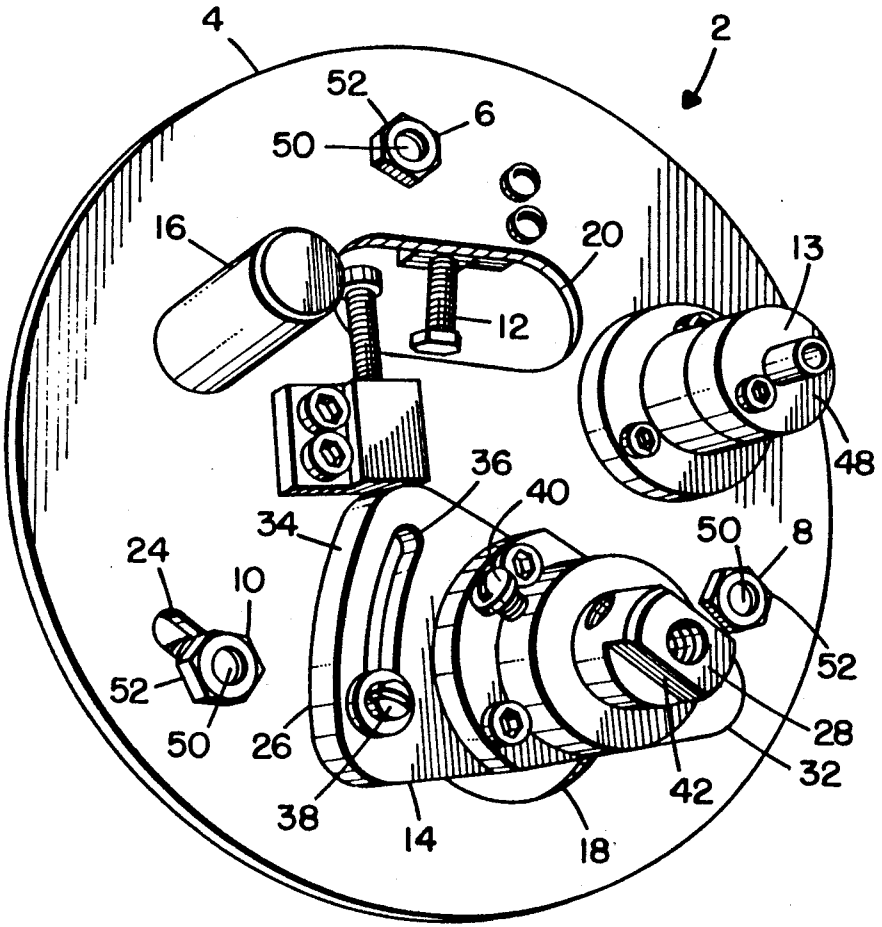
FIG. 1 is a perspective view of a first side of a weld grinding apparatus incorporating features of the present invention.
FIG. 2 is a perspective view of the opposite side of the weld grinding apparatus shown in FIG. 1 attached to a valve stem receiving area of a valve.

Referring now to FIG. 1, there is shown a perspective view of a grinding apparatus 2 incorporating features of the present invention. The grinding apparatus 2, in the embodiment shown, is a weld grinding apparatus for use in grinding welds in an interior portion of a valve at a valve stem receiving area. However, the present invention can be used for grinding or performing other operations in the interior of any conduit having an aperture. The grinding apparatus 2 generally comprises a faceplate 4, three cam assemblies 6, 8 and 10, a locking bolt assembly 12, a guide tube assembly 13 and a grinder assembly 14. The faceplate 4, in the embodiment shown, has a disc like shape with various apertures passing therethrough. The faceplate 4 may be made from any suitable material such as metal. In the embodiment shown, the faceplate 4 also comprises a handle 16 for an operator to rotatably manipulate the grinding apparatus 2 as will be described below. In the embodiment shown, the faceplate 4 comprises a grinder assembly aperture 18, a locking bolt assembly access aperture 20, a guide tube aperture 22 (see FIG. 2) two cam assembly apertures (not shown) for passage of a portion of the first and second cam assemblies 6 and 8 therethrough and a third cam assembly aperture 24 for passage of the third cam assembly 10 therethrough.

The grinder assembly 14 generally comprises a movable motor mount 26, an adjustable shaft 28 and a grinding wheel 30 (see FIG. 2). The movable motor mount 26, in the embodiment shown, is pivotably mounted to the faceplate 4 at a first end 32 and adjustably mounted to the faceplate 4 at a second end 34 via a slot 36 and bolt 38. The shaft 28 is adjustably mounted to the motor mount 26 for longitudinal movement therein. The set screw 40 can fix the longitudinal location of the shaft 28 relative to the motor mount 26 at a desired location. A first end 42 of the shaft 28 is suitably sized and shaped for connection to a pneumatic motor to provide axial rotation for the shaft 28. The shaft 28 has a second end 44 located at the opposite side of the faceplate (see FIG. 2) with the shaft 28 passing through the grinder assembly aperture 18.

The guide tube assembly 13 generally comprises a guide tube 46 (see FIG. 2) and a guide tube mount 48 (see FIG. 1). The guide tube 46 is fixedly mounted to the guide tube mount 48 with a portion thereof passing through the guide tube aperture 22 in the faceplate 4. The guide tube mount 48 generally fixedly connects the guide tube 46 with the faceplate 4. The guide tube 46 is generally provided for providing a path for an instrument, such as a fiber optic scope (not shown), for viewing a desired target area. As shown in FIG. 2, the guide tube 46 extends through the faceplate 4 and is bent in the direction of the grinding wheel 30. Thus, an instrument such as a fiber optic scope (not shown) can be passed through the guide tube 46 from the first side of the faceplate 4 shown in FIG. 1 to the second side of the faceplate shown in FIG. 2. In a preferred embodiment the guide tube 46 is stationary relative to the faceplate 4. However, in an alternate embodiment, the guide tube 46 may be movable relative to the faceplate 4.

Referring also to FIG. 2, the cam assemblies 6, 8 and 10 shown in FIG. 1 each generally comprise a shaft 50, a nut 52 and a rotatable cam 54 (FIG. 2) rotatably mounted to the shaft 50. In the embodiment shown, the first and second cam assemblies 6 and 8 are stationarily mounted to the face plate 4 with only the cams 54 being movable. The third cam assembly 10 is adjustably mounted in the elongate cam assembly aperture 24 and can be adjusted and fixed at different locations in the aperture 24 as desired. The cams 54 are suitably mounted on the faceplate 4 for contacting the interior portion of an aperture for rotatably mounting the grinding apparatus 2 at the aperture as indicated by arrow A. In the embodiment shown in FIG. 2, the grinding apparatus is shown rotatably mounted at an aperture to a valve 56 at a valve stem area where the valve actuator, bonnet and valve gate have been removed.

The locking bolt assembly 12 generally comprises a bolt 58 and a housing 60. The housing 60 is fixedly connected to the faceplate 4 on the interior side of the faceplate with the bolt 58 threadingly engaged with the housing 60 for movement as indicated by arrow B. The locking bolt assembly access aperture 20 allows an operator to have access to the bolt 58 when the grinding apparatus 2 is attached to a valve. The bolt 58 is generally intended for contacting an interior portion of the valve 56 and act as a locking device to lock the grinding apparatus 2 at a predetermined position at the valve 56. When the bolt 58 clampingly engages the valve 56 the grinding apparatus 2 is prevented from axial rotation and is locked in place. With the bolt 58 not in contact with the valve 56, as shown in FIG. 2, the grinding apparatus 2 is substantially fee to rotate as indicated by arrow A.

The grinding apparatus 2, in the embodiment described above, is generally capable of grinding an internal surface area of a conduit or valve. The cam assemblies 6, 8 and 10 allow the grinding wheel 30 to remove or grind a specific area on a 360° circumference as the grinding apparatus 2 is rotated about its axis. An operator can rotate the apparatus with the aid of the handle 16. The adjustable motor mount 26 allows the grinding wheel 30 to be moved radially relative to the faceplate. This allows the grinding wheel 30 to contact the interior of the conduit for various different depths of grinds or cuts. In addition, with the use of the locking bolt assembly 12, the grinding apparatus 2 may be locked at a specific location at a conduit or valve for concentrated grinding at a specific interior portion to remove a local defect. Thus, the grinding apparatus 2 can remove both a local defect as well as a continual defect on a 360° circumference. In addition, the guide tube assembly 13 allows insertion of a fiber optic scope behind the faceplate 4 for observation of the setting up of the grinding equipment and observation during the actual grinding operation.

It should be understood that the foregoing description is only illustrative of the invention. Various alternatives and modifications can be devised by those skilled in the art without departing from the spirit of the invention. Accordingly, the present invention is intended to embrace all such alternatives, modifications and variances which fall within the scope of the appended claims.

What is claimed is:

1. A grinding apparatus for grinding the interior of a conduit, the apparatus comprising:

faceplate means for positioning on a conduit aperture;

cam means on said faceplate means for rotatably mounting said faceplate means with said conduit aperture, said cam means being mounted on said faceplate means for contacting an interior portion of said conduit;

locking means for selectively locking said faceplate means in a predetermined position at said conduit aperture; and grinding means movably mounted on said faceplate means for grinding an interior portion of said conduit; said grinding means being movable in a substantially radial direction relative to said faceplate means whereby said grinding means can be fixed to said faceplate means at a predetermined position and said faceplate means can be rotated about said conduit aperture to rotate said grinding means about its axis to grind the inner circumference of said conduit, and said faceplate means can be locked at a second predetermined position at said conduit aperture and said grinding means can be radially moved relative to said faceplate means to grind an interior portion of a conduit.

2. An apparatus as in claim 1 wherein said faceplate means comprises a handle for rotating said faceplate means relative to said conduit aperture.

3. An apparatus as in claim 1 wherein said cam means comprises at least three cams on an interior side of said faceplate means and at least one of said cam means is adjustable relative to said faceplate means.

4. An apparatus as in claim 1 wherein said locking means comprises a bolt mounted to an interior side of said faceplate for radial movement to clampingly engage an interior of said conduit.

5. An apparatus as in claim 4 wherein said faceplate comprises an aperture for accessing said bolt when the apparatus is connected to said conduit.

6. An apparatus as in claim 1 further comprising means for positioning a instrument for viewing a target area, said positioning means comprising a tube passing through said faceplate means.

7. An apparatus as in claim 1 wherein said grinding means at least partially passes through an aperture in said faceplate means.

8. An apparatus as in claim 7 wherein said grinding means comprises a pneumatic motor and a grinding wheel.

9. An apparatus as in claim 8 wherein said grinding means is movably mounted to said faceplate means by a pivotable motor mount.

10. An apparatus as in claim 9 further comprising means for limiting movement of said pivotable motor mount.

11. An apparatus as in claim 9 wherein said motor mount is pivotably connected to said faceplate means at a first position proximate said faceplate aperture and adjustably mounted at a second position proximate said faceplate aperture opposite said first position.

12. An apparatus as in claim 8 wherein said grinding wheel is longitudinally adjustable relative to said faceplate means for various depths of grinding inside said conduit.

13. An apparatus as in claim 1 wherein said faceplate means can rotate 360 degrees around an inner circumference of said conduit for grinding in a 360 degree path.

14. A weld grinding apparatus for grinding welds in an interior portion of a valve stem receiving area of a valve; the apparatus comprising:

faceplate means for mounting over a valve stem receiving aperture;

means for mounting said faceplate means to said valve stem receiving aperture including cam means mounted on said faceplate means for contacting an interior portion of said valve stem receiving area, said cam means allowing said faceplate means to rotatably move at said valve stem receiving aperture, and locking means for selectively locking said faceplate means at a predetermined position at said valve stem receiving aperture;

grinding means movably mounted on said faceplate means for grinding an interior portion of said valve stem receiving area, said grinding means comprising a motor means, a grinding wheel and a pivoting motor mount for movably mounting said motor means and said grinding wheel relative to said faceplate means for substantially radial movement relative thereto; and guide tube means for passage of an instrument for viewing a target area therethrough whereby said faceplate means can be rotatably mounted to said valve stem receiving aperture of said valve for axial rotation and radial movement of said grinding means relative to said valve stem receiving area to grind an interior portion of said receiving area as said faceplate means is rotated and said faceplate means can be locked to a predetermined position at said receiving aperture for moving said grinding means radially relative to said faceplate means for grinding a specific interior portion of said valve receiving area.

* * * * *